US005222333A

United States Patent [19]

Watanabe et al.

[11] Patent Number: 5,222,333

[45] Date of Patent: Jun. 29, 1993

[54] ROTARY POLISHING TOOL

[75] Inventors: Noboru Watanabe; Kunihiro Miyao, both of Kyoto, Japan

[73] Assignees: Miyai Sumflex Industries Co., Ltd., Osaka; Shoken Industrial Co., Ltd., Kyoto, both of Japan

[21] Appl. No.: 953,210

[22] Filed: Sep. 29, 1992

Related U.S. Application Data

[63] Continuation of Ser. No. 731,250, Jul. 17, 1991, abandoned.

[30] Foreign Application Priority Data

Sep. 3, 1990 [JP] Japan ..... 2-92854[U]

[51] Int. Cl.[5] ..... B24D 11/00

[52] U.S. Cl. ..... 51/401; 51/358

[58] Field of Search ..... 51/394, 401, 407, 170 T, 51/170 MT, 328, 204, 206 NF, 209 R

[56] References Cited

U.S. PATENT DOCUMENTS

| | | | |
|---|---|---|---|
| 1,900,313 | 3/1933 | Stratford | 51/328 |
| 2,070,764 | 2/1937 | Webster | 51/209 R |
| 2,241,433 | 5/1941 | Walker | 51/209 R |
| 2,478,074 | 8/1949 | Atkin | 51/170 T |
| 2,581,567 | 1/1952 | Wiley | 51/358 |
| 3,082,582 | 3/1963 | Jeske | 51/407 |
| 3,896,593 | 7/1975 | Rine | 51/206 NF |
| 4,307,480 | 12/1981 | Fallen | 51/388 |
| 4,694,615 | 9/1987 | MacKay, Jr. | 51/209 R |
| 4,754,577 | 7/1988 | MacKay, Jr. | 51/209 R |
| 4,809,467 | 3/1989 | De Fazio | 51/394 |
| 4,989,375 | 2/1991 | Henmi et al. | 51/206 NF |
| 5,018,314 | 5/1991 | Fushiya et al. | 51/170 MT |

FOREIGN PATENT DOCUMENTS

| | | |
|---|---|---|
| 3416186 | 5/1983 | Fed. Rep. of Germany . |
| 3741279 | 6/1989 | Fed. Rep. of Germany . |
| 63-17652 | 5/1988 | Japan . |
| 0034676 | 2/1989 | Japan . |

*Primary Examiner*—Bruce M. Kisliuk
*Assistant Examiner*—Bryan Reichenbach
*Attorney, Agent, or Firm*—Nikaido, Marmelstein, Murray & Oram

[57] ABSTRACT

A rotary polishing tool comprises a disk-shaped polishing portion corresponding to a workpiece and a disk-shaped substrate which is positioned on the rotary center of the polishing portion for supporting the polishing portion. The substrate is provided with a mounting hole through which a driving shaft is passed on the rotary center. The substrate is made of metal and is provided with a plurality of holes, and there is provided a rubber layer which is interposed between the polishing portion and the substrate and vulcanized and bonded to the polishing portion and the substrate to fix the polishing portion and the substrate to each other.

11 Claims, 3 Drawing Sheets

ROTARY POLISHING TOOL

This application is a continuation of application Ser. No. 731,250 filed Jul. 17, 1991 now abandoned.

BACKGROUND OF THE INVENTION

1. Field of the Invention

The present invention relates to a rotary polishing tool which is driven by an electric motor for polishing a workpiece.

2. Description of the Prior Art

Such rotary polishing tools conventionally used include one comprising a disk-shaped polishing portion corresponding to a workpiece and a disk-shaped substrate made of resin for supporting the polishing portion with the polishing portion being bonded thereto. The polishing work using such a rotary polishing tool is performed by mounting this tool on a driving shaft of an electric motor and rotating the same to press the above polishing portion against the workpiece.

Meanwhile, during the above described work, the tool is rotated at high peripheral speed of, for example, a maximum of approximately 80 m/s. Consequently, a substantially large centrifugal force is developed in this tool. In addition, a large reaction force is applied to this tool from the workpiece. Accordingly, it is particularly desired that the above substrate has sufficient strength.

Therefore, it is considered that the above substrate is made of metal to improve the strength thereof. If this substrate is merely a metal plate, however, such problems arise that the tool becomes heavy and the centrifugal force becomes the larger.

Furthermore, if the above metal plate is merely flat, there is a possibility that a part of the polishing portion is stripped off from the substrate by an impact force applied to the polishing portion from the workpiece during the work, resulting in insufficient strength to support the polishing portion by the substrate.

SUMMARY OF THE INVENTION

A first object of the present invention is for a tool to have sufficient strength to oppose a centrifugal force and a reaction force which is applied from a workpiece.

A second object of the present invention is to prevent a tool from being heavy even if the tool has the above described strength.

A third object of the present invention is for a polishing portion constituting a tool to be supported by a substrate while holding sufficient strength.

According to the present invention, a rotary polishing tool comprises a disk-shaped polishing portion corresponding to a workpiece and a disk-shaped substrate which is positioned on the rotary center of the polishing portion for supporting the polishing portion. The substrate is provided with a mounting hole through which a driving shaft is passed on this rotary center. The above substrate is made of metal and is provided with a plurality of holes, and there is provided a rubber layer which is interposed between the polishing portion and the substrate which is vulcanized and bonded to the polishing portion and the substrate to fix the polishing portion and the substrate to each other.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 1 is a plan view and FIG. 2 is a sectional side elevation view;

DESCRIPTION OF THE PREFERRED EMBODIMENTS

Figure 1:
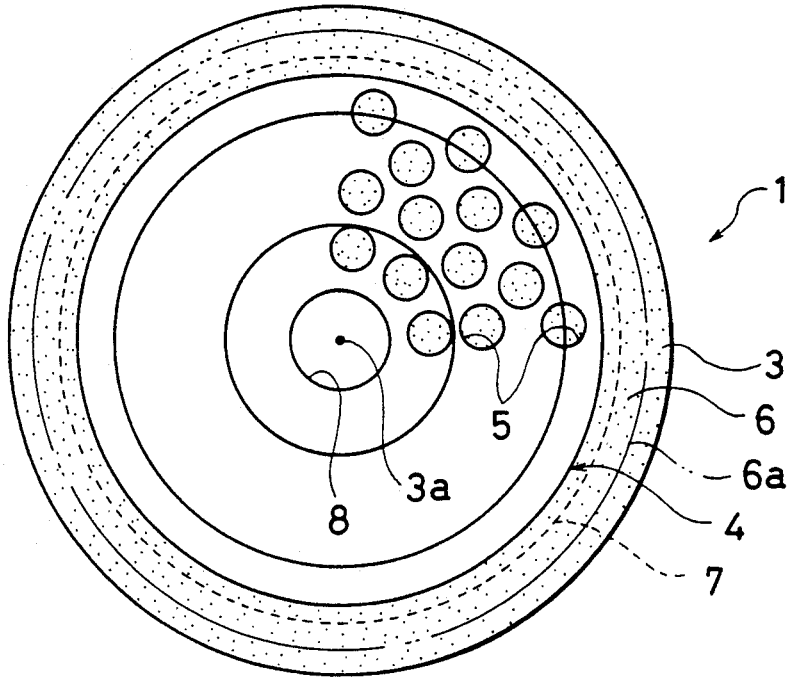
FIGS. 1 and 2 are diagrams showing a first embodiment, where
Figure 2:
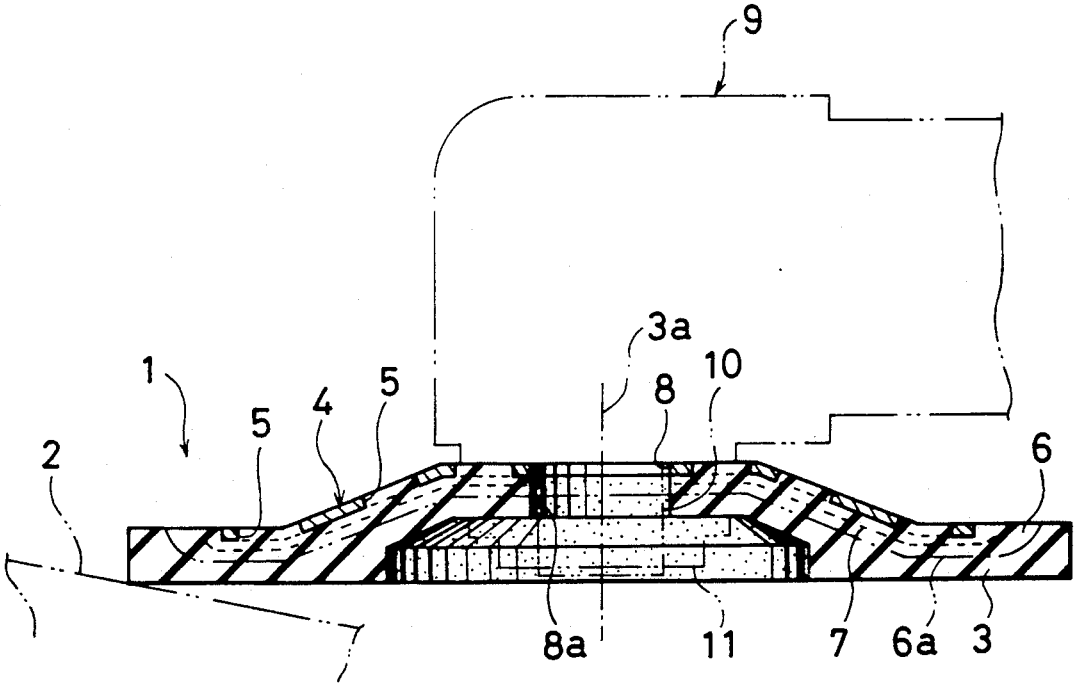

FIGS. 1 and 2 show a first embodiment.

In FIGS. 1 and 2, reference numeral 1 denotes a rotary polishing tool. This rotary polishing tool 1 has a disk-shaped polishing portion 3 corresponding to a workpiece 2 and a substrate for supporting the polishing portion 3. This substrate 4 is positioned on a rotary center 3*a* of the above polishing portion 3, and has a disk shape and an approximately circular truncated conical shape.

The above polishing portion 3 is made of a rubber material having abrasive grains included therein. On the other hand, the above substrate 4 is a metal plate made of iron and is provided with a plurality of circular holes 5. Although the holes 5 are formed almost uniformly throughout the substrate 4, they are illustrated only in a part of the substrate 4 in FIG. 1.

A rubber layer 6 is interposed between the polishing portion 3 and the substrate 4. This rubber layer 6 is vulcanized and bonded to the polishing portion 3 and to the substrate 4, to fix the polishing portion 3 and the substrate 4 to each other.

In FIGS. 1 and 2, reference numeral 6*a* denotes a boundary surface of the above rubber layer 6 and the above polishing portion 3. Since the above polishing portion 3 is also made of a rubber material as described above, however, the polishing portion 3 and the rubber layer 6 are simultaneously vulcanized and bonded to the substrate 4, to be integrated with each other. Therefore, the above boundary surface 6*a* does not, in fact, clearly exist.

Glass fiber 7 is embedded in the above rubber layer 6 so that they are integrated with each other, thereby to strengthen the rubber layer 6.

The above substrate 4 is provided with a circular mounting hole 8 around the above rotary center 3*a*. In addition, the polishing portion 3 is also provided with another mounting hole 8*a* connected to the above mounting hole 8. The above described holes 5 are formed in a portion other than the outer periphery of the substrate 4 and the periphery of the mounting hole 8. More specifically, both the outer and inner peripheries of the substrate 4 have a continuously circular shape, so that the decrease in strength of the substrate 4 due to the formation of the holes 5 is effectively restrained.

At the time of the polishing work, a driving shaft 10 of a handy electric motor 9 is first passed through the above mounting hole 8 and the other mounting hole 8*a* and a flanged nut 11 is screwed into the driving shaft 10, thereby to mount the rotary polishing tool 1 on the above driving shaft 10. The rotary polishing tool 1 is then rotated by driving of the electric motor 9. If the polishing portion 3 is pressed against the above workpiece 2, this workpiece 2 is polished.

Meanwhile, for convenience of forming, the above rubber layer 6 may be made of exactly the same material as that of the polishing portion 3, that is, the polishing portion 3 and the rubber layer 6 may be integrally formed using a rubber material having abrasive grains included therein. In this case, the above boundary surface 6*a* does not exist.

In the above described construction, the substrate 4 for supporting the polishing portion 3 is made of metal and is further formed in an approximately circular truncated conical shape. Accordingly, the strength of the rotary polishing tool 1 can be considerably improved, as compared with the conventional case where the substrate 4 is made of resin. Consequently, this rotary polishing tool 1 has sufficient strength to oppose a centrifugal force and a reaction force which is applied from the workpiece 2.

Furthermore, since the holes 5 are formed in the above substrate 4, the substrate 4 can be prevented from being heavy uselessly. Accordingly, the rotary polishing tool 1 can be lightweight while sufficiently holding the strength.

Additionally, there is provided the rubber layer 6 which is interposed between the polishing portion 3 and the substrate 4 which is vulcanized and bonded to the polishing portion 3 and to the substrate 4 to fix the polishing portion 3 and the substrate 4 to each other. Accordingly, when the polishing portion 3 is brought into contact with the workpiece 2 so that an impact force is applied to the polishing portion 3 from the workpiece 2, this impact force is absorbed by the above rubber layer 6. Consequently, a part of the polishing portion 3 can be prevented from being stripped off from the substrate 4 by the above impact force. That is, the polishing portion 3 is supported by the substrate 4 while holding sufficient strength.

Moreover, the above polishing portion 3 is firmly bonded to the lower surface of the substrate 4 through the rubber layer 6 strengthened by the glass fiber 7. In addition, the rubber layer 6 enters the above holes 5 at the time of vulcanization, thereby to sufficiently strengthen the above bonding. Consequently, also in this point, the polishing portion 3 is supported by the substrate 4 while holding sufficient strength.

Meanwhile, it is not necessary that the glass fiber 7 is provided and the nut 11 is flanged.

The following drawings show the other embodiments. Common reference numerals are assigned to constituent elements which are common to the embodiments and the above described first embodiment. The description of the common constituent elements and the functions concerning the constituent elements are omitted and hence, only different constituent elements and functions will be described.

Figure 3:
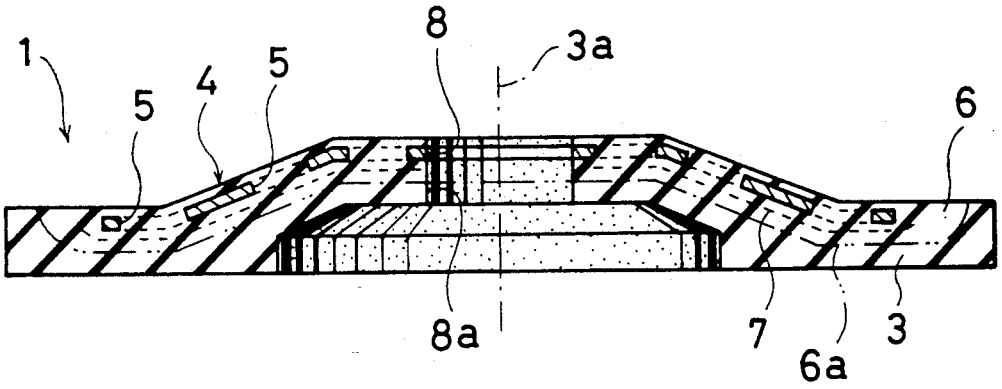
FIG. 3 is a sectional side elevation view showing a second embodiment.

FIG. 3 shows a second embodiment.

According to the second embodiment, a substrate 4 is embedded in a rubber layer 6 so that they are integrated with each other. By doing so, the adhesive strength of a polishing portion 3 to the substrate 4 is further improved.

Figure 4:
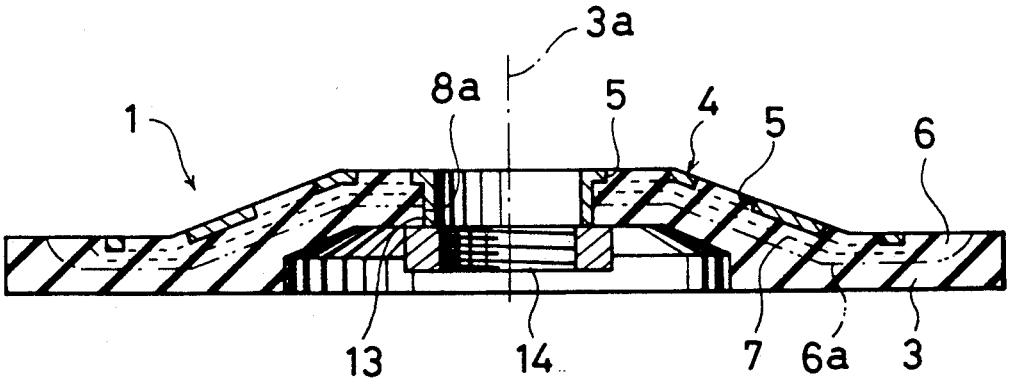
FIG. 4 is a sectional side elevation view showing a third embodiment.

FIG. 4 shows a third embodiment.

According to the third embodiment, a reinforcing pipe 13 made of metal is fitted in the inner peripheral surface of another mounting hole 8*a*. This pipe 13 is formed by squeezing a substrate 4 using a press. This pipe 13 may be welded to the substrate 4. In addition, a nut 14 is welded to the lower end of the above pipe 13.

The nut 14 is screwed into a driving shaft 10 of an electric motor 9 to screw the pipe 13 on the driving shaft 10, thereby to mount a rotary polishing tool 1 on the electric motor 9. In this case, the above pipe 13 prevents a polishing portion 3 and a rubber layer 6 from being deformed. In addition, the tool 1 is firmly mounted on the electric motor 9 by screwing the above pipe 13 on the driving shaft 10, to reliably prevent the vibration caused when a centrifugal force is developed.

Furthermore, the polishing portion 3 and the rubber layer 6 are sandwiched between the substrate 4 and the nut 14 in the periphery of the other mounting hole 8*a*. Consequently, the polishing portion 3 is supported by the substrate 4 more reliably. Meanwhile, the nut 14 and the pipe 13 may be separately formed.

Figure 5:
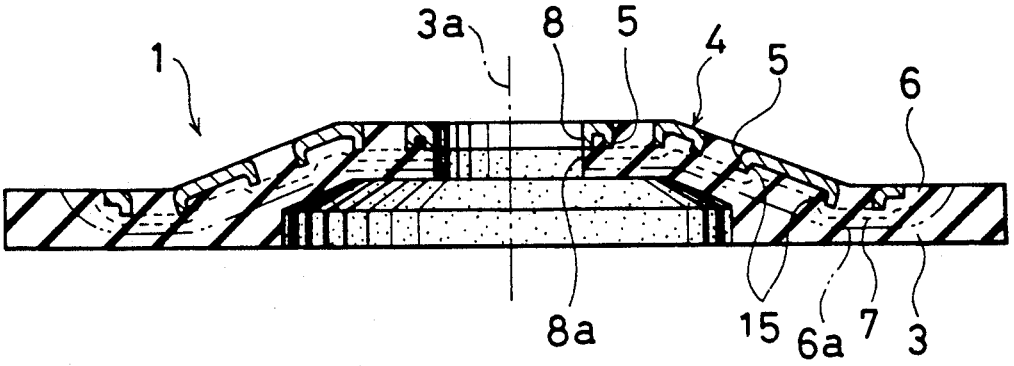
FIG. 5 is a sectional side elevation view showing a fourth embodiment.

FIG. 5 shows a fourth embodiment.

According to the fourth embodiment, annulus ring portions 15 are respectively formed in opening edges of holes 5 and a mounting hole 8 by press working of the opening edges. The annulus ring portions 15 are respectively projected into a rubber layer 6 from a substrate 4. Consequently, the strength of the substrate 4 is improved, and bonding of the rubber layer 6 to the substrate 4 is further strengthened. Meanwhile, the amount of projection of each of the above annulus ring portions 15 is approximately 0.5 to 1 mm.

Figure 6:
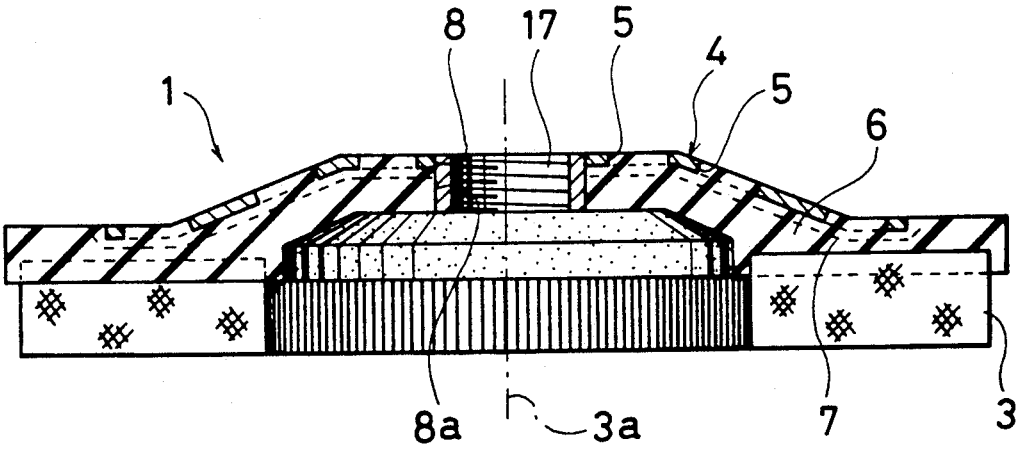
FIG. 6 is a sectional side elevation view showing a fifth embodiment.

FIG. 6 shows a fifth embodiment,

According to the fifth embodiment, a nut 17 is fitted in the inner peripheral surface of each of a mounting hole 8 and another mounting hole 8*a* and is welded to a substrate 4, to reinforce a rotary polishing tool 1.

Furthermore, a polishing portion 3 is constituted by a lot of pieces of abrasive paper or abrasive felt which are radially disposed around a rotary center 3*a*. A part of the polishing portion 3 is embedded in a rubber layer 6 so that the polishing portion 3 is bonded to the rubber layer 6.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. In a rotary polishing tool comprising a disk-shaped polishing portion and a disk-shaped substrate which is positioned on the rotary center of the polishing portion for supporting the polishing portion, the substrate being provided with a first mounting hole adapted to receive a driving shaft passed therethrough on the rotary center, wherein:

said substrate is metal and contains a plurality of holes therethrough;

a rubber layer, filled with glass fiber to strengthen such is interposed between said polishing portion and said substrate, wherein said rubber layer is vulcanized and bonded to the polishing portion and to the substrate;

said plurality of holes being substantially filled with vulcanized rubber of said rubber layer whereby one surface of said substrate and said holes are substantially embedded in said rubber;

a portion of said substrate, which comprises the circumferential edges of at least some of said holes, being thicker than the remainder of said substrate and being disposed from a surface of said substrate directed toward said rubber and is therefore embedded further into said rubber than the remainder of said substrate, whereby the circumferential edges of at least some of said holes are substantially annular in shape, and said rubber substantially surrounds said portion of said substrate;

whereby fixing the polishing portion and the substrate to each other.

2. The rotary polishing tool according to claim 1, wherein the polishing portion is made of a rubber material having abrasive grains included therein and wherein the rubber of said polishing portion and the rubber layer are the same material.

3. The rotary polishing tool according to claim 1, wherein said substrate has a truncated, approximately circular conical shape.

4. The rotary polishing tool according to any one of claims 1, 2 or 3, wherein the holes are formed in a circular shape.

5. The rotary polishing tool according to claim 1, wherein the substrate is embedded in the rubber layer.

6. The rotary polishing tool according to claim 1, wherein the polishing portion is provided with a second mounting hole connected to and concentric with said first mounting hole, and a reinforcing pipe is fitted in the inner peripheral surface of said second mounting hole.

7. The rotary polishing tool according to claim 1, wherein the circumferential edges of the first mounting hole in said substrate are also annular and are also further embedded in the rubber layer.

8. The rotary polishing tool according to claim 1, wherein the polishing portion is made of abrasive paper.

9. The rotary polishing tool according to claim 1, wherein the polishing portion is made of abrasive felt.

10. The rotary polishing tool according to claim 1, wherein the holes are disposed between the first mounting hole and the periphery of the substrate.

11. The rotary polishing tool according to claim 1 wherein said portion of said substrate extends about 0.5 to 1 mm into said rubber.

* * * * *